US008016984B2

(12) United States Patent
Anzai et al.

(10) Patent No.: US 8,016,984 B2
(45) Date of Patent: Sep. 13, 2011

(54) ION-PERMEABLE DIAPHRAGM

(75) Inventors: Syogo Anzai, Tokyo (JP); Noriko Tsujinaka, Tokyo (JP)

(73) Assignee: Kurita Water Industries Ltd., Tokyo (JP)

( * ) Notice: Subject to any disclaimer, the term of this patent is extended or adjusted under 35 U.S.C. 154(b) by 289 days.

(21) Appl. No.: 12/320,598

(22) Filed: Jan. 29, 2009

(65) Prior Publication Data

US 2010/0187103 A1 Jul. 29, 2010

(51) Int. Cl.
*C25B 13/04* (2006.01)
*C25C 17/04* (2006.01)

(52) U.S. Cl. ..... 204/295; 204/296

(58) Field of Classification Search ..... 204/296, 204/295

See application file for complete search history.

(56) References Cited

U.S. PATENT DOCUMENTS

2008/0008937 A1* 1/2008 Eylem et al. ..... 429/218.1

FOREIGN PATENT DOCUMENTS

JP B-62-50557 10/1987
JP B-2604734 1/1997

* cited by examiner

*Primary Examiner* — Bruce Bell
(74) *Attorney, Agent, or Firm* — Posz Law Group, PLC

(57) ABSTRACT

An ion-permeable diaphragm comprises a membrane material containing a calcium phosphate compound or calcium fluoride as a hydrophilic inorganic material. The calcium phosphate compound is preferably fluoroapatite or hydroxyapatite. The membrane material is obtained by incorporating a stretched organic fiber fabric into a membrane-forming mixture formed by the hydrophilic inorganic material and an organic binding material selected from among polysulfone, polypropylene, polyvinylidene fluoride or the like. As a result, there can be provided an ion-permeable membrane of low electric resistance for use in alkaline water electrolysis devices.

10 Claims, 1 Drawing Sheet

ION-PERMEABLE DIAPHRAGM

BACKGROUND OF THE INVENTION

1. Field of the Invention

The present invention relates to an ion-permeable diaphragm for use in alkaline water electrolysis apparatus, and more particularly to an ion-permeable diaphragm for use in alkaline water electrolysis apparatus having a structure in which an ion-permeable diaphragm is sandwiched between electrodes.

2. Description of the Related Art

In the context of the current energy situation, hydrogen is gathering widespread attention, for a number of reasons, as a new energy source for replacing petroleum. Examples of industrial hydrogen manufacturing methods include, for instance, gasification of coke or petroleum, and water electrolysis.

The former method involves complex operations and requires extremely large facilities, and is thus problematic in terms of initial cost.

On the other hand, the latter method uses water, which is readily available, as a raw material. In water electrolysis, a plurality of electrode pairs are provided in an electrolytic bath that is partitioned by ion-permeable diaphragms, through which an alkaline electrolyte such as KOH or the like can pass, disposed between the electrodes that form the electrode pairs. Hydrogen is generated on the cathode side and oxygen on the anode side of the ion-permeable diaphragms. The ion-permeable diaphragm and the solution to be electrolyzed, however, are interposed between the electrodes. This results in greater electric resistance and worse electrolysis efficiency, which is problematic. Nevertheless, such water electrolysis methods are workable in that they can generate hydrogen even with relatively small-scale apparatus, and are thus promising in terms of enhancing electrolysis efficiency.

The membranes used in electrochemical electrolytic baths, typified by such alkaline water electrolysis apparatus, must have the following characteristics.

(1) The membrane must let through only ions, while gas must not diffuse or pass through the membrane.

(2) The membrane should be physically and chemically durably in the electrolyte.

(3) The membrane should have low electric resistance.

Asbestos yarn is widely used in practice in electrolysis diaphragms having the above characteristics. Depending on the circumstances, however, the temperature of the electrolyte may rise to 100° C. or higher. Asbestos yarn corrodes at temperatures of 100° C. or above, and cannot then be used. Moreover, the health hazards posed by asbestos have been extensively reported, and thus the use of asbestos is fraught with significant problems.

For instance, an ion-permeable diaphragm using a polymeric porous membrane or an ion-exchange membrane, and a metal oxide membrane of NiO or the like (Japanese Examined Patent Application Laid-open No. S62-50557), as well as an ion-permeable diaphragm comprising, as a membrane material, for instance a composite material of an inorganic substance and an organic polymer (Japanese Patent No. 2604734) have been proposed as ion-permeable diaphragms satisfying the above characteristics (1) and (2), and having yet lower electric resistance (3).

Among the ion-permeable diaphragms comprising the above membrane materials, polymeric porous membranes are advantageous in being flexible and having strong resistance against mechanical damage. The polymer materials used, however, are hydrophobic, and hence the solvated ions move with difficulty in the electrolyte, even in the case of a porous membrane, so that electric resistance becomes substantial. The characteristics of the electrolytic bath are thus severely impaired, which is problematic. In alkaline water electrolysis apparatus for generating a gas, polymeric porous membranes and ion-exchange membranes are problematic in that gas bubbles adhere to the surface of the membrane, thereby greatly increasing electric resistance. In particular, the membrane can deteriorate on account of the formation of high-temperature portions, called hot spots, when bubbles aggregate and give rise to local large increases in electric resistance.

Metal oxide membranes of NiO or the like, such as the one disclosed in Japanese Examined Patent Application Laid-open No. S62-50557, are manufactured by sintering. Dense sintered diaphragms, which do not allow a gas to pass or diffuse, are problematic in terms of membrane size limitations, which make sintered diaphragms unsuitable for large electrolytic baths.

The ion-permeable diaphragm disclosed in Japanese Patent No. 2604734, in which the diaphragm comprises a composite material of an inorganic substance and an organic polymer, is an ion-permeable diaphragm where micropores are formed through membrane formation using zirconium oxide or polyantimonic acid as an inorganic wettable material, and using, for instance, a fluorocarbon copolymer or a polysulfone as a binder. The ion-permeable diaphragm using such a composite material exhibits excellent smoothness and extremely good ion conductivity, and is thus appropriate as a diaphragm for alkaline water electrolysis devices.

Although the inorganic wettable material used in the ion-permeable diaphragm disclosed in Japanese Patent No. 2604734 is hydrophilic, a yet more hydrophilic inorganic material is desirable in terms of reducing the electric resistance of the ion-permeable diaphragm, which offers thus room for improvement.

SUMMARY OF THE INVENTION

With a view to solving the above problems, it is an object of the present invention to provide an ion-permeable diaphragm of low electric resistance for use in alkaline water electrolysis devices.

In order to solve the above-problems, the present invention provides an ion-permeable diaphragm used in alkaline water electrolysis, wherein a membrane material of the ion-permeable diaphragm contains a calcium phosphate compound or calcium fluoride as a hydrophilic inorganic material (Invention 1).

According to the above invention (Invention 1), the ions in alkaline water electrolysis can pass quickly through the ion-permeable diaphragm having enhanced hydrophilicity, which allows reducing the electric resistance of the diaphragm itself. Moreover, the porous structure of the ion-permeable diaphragm is dense, such that gas bubbles cannot pass through the pores. As a result, the oxygen and the like generated on the anode side does not become mixed with the hydrogen generated on the cathode side of the ion-permeable diaphragm, which allows thus keeping high the purity of the hydrogen gas.

In the above invention (Invention 1), preferably, the calcium phosphate compound as the hydrophilic inorganic material is fluoroapatite (FAP) or hydroxyapatite (HAP) (Inventions 2 and 3). In the above invention (Invention 1), preferably, the membrane material is obtained by incorporating an organic fiber fabric into a mixture comprising the hydrophilic inorganic material and an organic binding material selected from among polysulfone, polypropylene and polyvinylidene fluoride (Invention 4). In the above invention (Invention 4), preferably, the organic fiber fabric is a polypropylene mesh (Invention 5).

According to the above inventions (Inventions 2 to 5), the membrane material itself exhibits extremely good hydrophilicity and excellent ion conductivity, and hence the ion-permeable diaphragm can be ideally used as a diaphragm for alkaline water electrolysis devices.

In the above inventions (Inventions 1 to 5), preferably, the thickness of the membrane material is 100 μm or greater (Invention 6). A thicker membrane material allows ensuring a desired membrane strength, but may entail an increase in the electric resistance of the membrane. According to the above invention (Invention 6), however, the membrane material exhibits extremely good hydrophilicity and excellent ion conductivity, so that a desired membrane strength can be ensured without increases in the electric resistance of the membrane, even if the membrane material is somewhat thick.

In the ion-permeable diaphragm of the present invention, thus, the ions in alkaline water electrolysis can pass quickly through the ion-permeable diaphragm having enhanced hydrophilicity. This allows reducing the electric resistance of the membrane, which in turn allows reducing power consumption in the alkaline water electrolysis device, while enhancing the electrolysis efficiency of the latter. Moreover, the oxygen and the like generated on the anode side does not become mixed with the hydrogen generated on the cathode side of the ion-permeable membrane, which allows allaying concerns relating to impaired hydrogen manufacturing efficiency.

DESCRIPTION OF THE PREFERRED EMBODIMENTS

Figure 1:
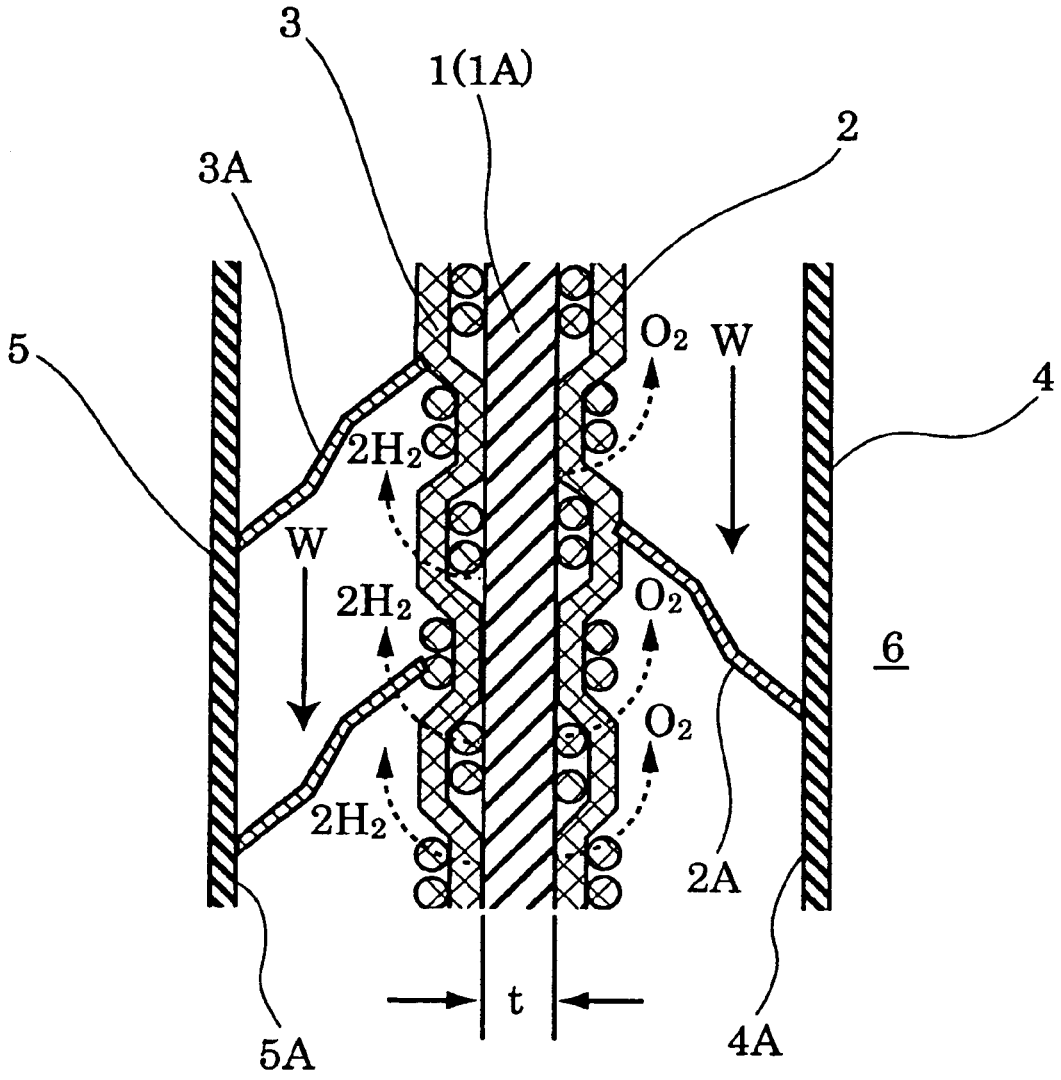
FIG. 1 is an enlarged cross-sectional diagram showing a constituent unit in an electric unit of an alkaline water electrolysis apparatus using an ion-permeable diaphragm according to an embodiment of the present invention.

Embodiments of the present invention are explained in detail next with reference to accompanying drawings.

FIG. 1 is an enlarged cross-sectional diagram showing a constituent unit in an electric unit of an alkaline water electrolysis apparatus using an ion-permeable diaphragm according to an embodiment of the present invention.

In FIG. 1, an ion-permeable diaphragm 1 is held sandwiched between two mesh electrodes 2, 3. The mesh electrodes 2, 3 are respectively connected to an anode side 4A and a cathode side 5A of bipolar electrodes 4, 5, via conductive members 2A, 3A, in such a manner that voltage is applied thereby across the ion-permeable diaphragm 1. In FIG. 1, the reference numeral 6 denotes an electrolytic bath, and W denotes a potassium hydroxide (KOH) solution, as an alkaline solution.

The membrane material 1A that forms the ion-permeable diaphragm 1 is not particularly limited, provided that it allows only ions through the membrane, that gas does not pass or diffuse across the membrane, and that the material is physically and chemically durable in alkaline solutions.

Preferred examples of the membrane material 1A include, for instance, membrane materials obtained by incorporating a stretched organic fiber fabric into a membrane-forming mixture comprising a hydrophilic inorganic material and an organic binding material selected from among polysulfone, polypropylene, polyvinylidene fluoride or the like.

Preferred examples of the hydrophilic inorganic material that can be used include, for instance, calcium phosphate compounds such as fluoroapatite (FAP), hydroxyapatite (HAP) or the like. The hydrophilic inorganic material is preferably used as a granulate. Preferably, the particle size of the granulate of the hydrophilic inorganic material is no greater than 5 μm, and comprises preferably, in particular, microparticles of a size no greater than 1 μm. Therefore, the granulate may be finely crushed beforehand using a mortar.

Examples of suitable hydrophilic inorganic materials other than the above-described calcium phosphate compounds include, for instance, calcium fluoride ($CaF_2$). The calcium fluoride is also preferably embodied as microparticles having a size no greater than 1 μm, as in the case of the above calcium phosphate compound. The calcium fluoride used can be not only commercially available industrial calcium fluoride, but also industrially recovered calcium fluoride. In the treatment process of fluorine-containing wastewater, for instance, fluorine is removed by being fixed in the form of $CaF_2$, which can then be re-used.

As the organic fiber fabric, there can be used, for instance, a mesh comprising polypropylene, or a mesh comprising a copolymer of ethylene and ethylene halogenated beforehand such as monochlorotrifluoroethylene or the like. As the organic fiber fabric there can be used a woven or a nonwoven fabric. The fiber diameter is preferably no greater than 1 mm, in particular, no greater than 0.5 mm. The dimensions of the texture of the organic fiber fabric are not particularly limited, but are preferably no greater than 4 $mm^2$, in particular no greater than 1 $mm^2$.

The membrane material 1A comprising the above-described hydrophilic inorganic material, organic binding material and organic fiber fabric can be manufactured, for instance, as described below.

Firstly, the organic binding material is dissolved in an organic solvent, and then the hydrophilic inorganic material is dispersed in the resulting solution to yield a suspension (slurry). This suspension (slurry) is uniformly coated, to a predetermined thickness, onto a smooth surface comprising an inert material, such as a glass plate or the like, to prepare a wet sheet. The organic fiber fabric, in a stretched state, is soaked in the wet sheet. The organic solvent is removed then by evaporation, leaching in a water bath or the like, while keeping the organic fiber fabric stretched, after which the membrane material 1A remaining on the smooth surface is stripped therefrom.

Examples of the organic solvent that can be used include, for instance, dimethylformamide, dimethylacetamide, dimethyl sulfoxide, N-methyl-2-pyrrolidone, mono- and diethers of ethylene glycol, or ketones such as methyl ethyl ketone.

The blending ratio of hydrophilic inorganic material (FAP, HAP, $CaF_2$) and organic binding material in the membrane material 1A is preferably such that the blending ratio of hydrophilic inorganic material ranges from 10 to 95 wt %. When the blending ratio of the hydrophilic inorganic material is smaller than 10 wt %, the electric resistance of the obtained membrane material 1A itself increases, which is undesirable from the viewpoint of the electric resistance in the ion-permeable diaphragm 1 using the membrane material 1A. When the blending ratio of the hydrophilic inorganic material exceeds 95 wt %, the mechanical strength of the membrane material 1A, in particular brittleness, becomes excessively low, which may make it more difficult to preserve membrane shape. The blending ratio of the hydrophilic inorganic material ranges preferably from 40 to 90 wt %, in particular from 75 to 85 wt %.

As the blending ratio of hydrophilic inorganic material increases vis-à-vis that of the organic binding material, the wettability (hydrophilicity) of the membrane material increases as well, which tends to reduce electric resistance in the membrane.

Electric resistance decreases as the blending ratio of hydroxyapatite (HAP), as the hydrophilic inorganic material, becomes higher, but miscibility with the organic binding material and the organic solvent becomes poorer. This results in higher slurry viscosity, and likelier separation, as compared with the case of a same weight percent of fluoroapatite (FAP). When using hydroxyapatite (HAP) as the hydrophilic inorganic material, therefore, the slurry is preferably prepared with a blending ratio of hydroxyapatite (HAP) of at most about 60 to 70 wt %.

Miscibility with the organic binding material and the organic solvent is good when using fluoroapatite (FAP) as the hydrophilic inorganic material, in which case a slurry can be prepared with the above-described blending ratio of 10 to 95 wt %. Preferably, the slurry is prepared with the above-described optimal blending ratio of 75 to 85 wt %.

In terms of handleability, therefore, fluoroapatite (FAP) is preferably employed as the hydrophilic inorganic material used in the membrane material.

The blending ratio of the organic solvent may be of 40 wt % or more relative to a total 100 wt % of the organic solvent and the organic binding material as the membrane-forming substance. The thickness of the manufactured wet sheet is preferably no greater than 2 mm, in particular no greater than 1.5 mm.

The thickness (t) of the membrane material 1A thus manufactured is preferably 100 μm or greater, and ranges preferably, in particular, from 300 to 600 μm. When the thickness of the membrane material 1A is smaller than 100 μm, the strength of the membrane material 1A for alkaline water electrolysis may be insufficient, whereas membrane electric resistance does not rise when the thickness of the membrane material 1A is 100 μm or greater.

The above-described ion-permeable diaphragm 1 has a membrane resistance (electric resistance) no greater than 1.75 $\Omega\cdot cm^2$, preferably no greater than 1.40 $\Omega\cdot cm^2$, in a 1 mol/L KOH solution at a temperature of 25° C.

When current flows in the bipolar electrodes 4, 5 of the electrolysis unit shown in FIG. 1 using such an ion-permeable diaphragm 1, voltage is generated, from the conductive members 2A, 3A, across the mesh electrodes 2, 3. The potassium solution W is electrolyzed thereby, to generate oxygen ($O_2$) at the interface between the ion-permeable diaphragm 1 and the mesh electrode 2 (anode).

At the interface between the ion-permeable diaphragm 1 and the mesh electrode 3 (cathode), meanwhile, there is generated a double amount of hydrogen ($H_2$). The electrolytic bath 6 in the electrolysis unit is partitioned by the ion-permeable diaphragm 1 into a cathode side and an anode side, and hence hydrogen gas can be manufactured by recovering only the hydrogen generated on the cathode side.

The ion-permeable diaphragm 1 comprises a highly hydrophilic inorganic material (inorganic wettable substance). Herein, the ions in the potassium hydroxide solution can move quickly since the membrane material 1A has a porous structure. The electric resistance of the ion-permeable diaphragm 1 is reduced as a result, whereby alkaline water electrolysis can be carried out with good efficiency.

Moreover, the porous structure of membrane material 1A is dense, so that although the solution can pass through the membrane material 1A, the bubbles of oxygen gas generated on the anode side and the bubbles of hydrogen gas generated on the cathode side cannot pass through the ion-permeable diaphragm 1. The gases, therefore, do not become mixed with each other. This allows the purity of the hydrogen gas obtained on the cathode side to be kept high.

The embodiments explained above are described to facilitate understanding of the present invention and is not to limit the present invention. Accordingly, respective elements disclosed in the above embodiments include all design modifications and equivalents belonging to the technical scope of the present invention.

EXAMPLES

The present invention is explained in further detail below on the basis of examples and comparative examples. However, the present invention is in no way meant to be limited to or by the examples.

Example 1

Manufacture of a Membrane Material Containing Fluoroapatite (FAP)

A suspension was prepared by mixing 60 wt % (30 g) of N-methyl-2-pyrrolidone (NMP), 32 wt % (16 g) of fluoroapatite (FAP, by Kanto Chemical) having an average particle size of 5 μm, and 8 wt % (4 g) of polysulfone (PSF, trade name UDEL, by Solvay Advanced Polymers), under thorough stirring to dissolve the polysulfone (PSF) and disperse the FAP.

Then, 10 mL of the resulting suspension were poured onto a 10 cm×10 cm glass frame over which there was stretched a 200-mesh polypropylene woven fabric (fiber diameter: 87 μm, trade name Nippu (polypropylene) strong mesh, by NBC) at a position 400 μm from the bottom, to prepare thereby a wet sheet having a surface area of 100 $cm^2$ and a thickness of about 500 μm.

Immediately after pouring the suspension, the frame was moved into a water bath, where it was left to stand for 5 minutes at room temperature, to leach the N-methyl-2-pyrrolidone (NMP) solvent out of the wet sheet. Thereafter, the sheet remaining on the frame was stripped and was held in water for a further 5 minutes, to yield a sheet-like membrane material. The obtained sheet-like membrane material had a thickness of about 400 μm.

Example 2

Manufacture of a Membrane Material Containing Hydroxyapatite (HAP)

A suspension was prepared by mixing 65 wt % (30 g) of N-methyl-2-pyrrolidone (NMP), 26 wt % (12 g) of hydroxyapatite (HAP, by Kishida Chemical) having an average particle size of 5 μm, and 9 wt % (4 g) of polysulfone (PSF, trade name UDEL, by Solvay Advanced Polymers), under thorough stirring to dissolve the polysulfone (PSF) and disperse the hydroxyapatite (HAP).

A sheet-like membrane material having a thickness of about 400 μm was manufactured out of the resulting suspension in the same way as in Example 1.

Example 3

Manufacture of a Membrane Material Containing Calcium Fluoride ($CaF_2$)

A suspension was prepared by mixing 65 wt % (30 g) of N-methyl-2-pyrrolidone (NMP), 26 wt % (12 g) of calcium fluoride ($CaF_2$, by Kishida Chemical) having an average particle size of 5 μm, and 9 wt % (4 g) of polysulfone (PSF, trade name UDEL, by Solvay Advanced Polymers), under thorough stirring to dissolve the polysulfone (PSF) and disperse the calcium fluoride ($CaF_2$).

A sheet-like membrane material having a thickness of about 400 μm was manufactured out of the resulting suspension in the same way as in Example 1.

Comparative Example 1

Manufacture of a Membrane Material Containing Zirconium Oxide (Membrane Equivalent to the Permeable Membrane Disclosed in Japanese Patent No. 2604734)

A suspension was prepared by mixing 60 wt % (30 g) of N-methyl-2-pyrrolidone (NMP), 32 wt % (16 g) of zirconium oxide ($ZrO_2$, by Kishida Chemical) having an average particle size of 5 μm, and 8 wt % (4 g) of polysulfone (PSF, trade name UDEL, by Solvay Advanced Polymers), under thorough stirring to dissolve the polysulfone (PSF) and disperse the zirconium oxide.

A sheet-like membrane material having a thickness of about 400 μm was manufactured out of the resulting suspension in the same way as in Example 1.

[Measurement of Electric Resistance]

The ion-permeable diaphragms thus obtained in Examples 1 to 3 and Comparative example 1 were dipped in a 1 mol/L KOH solution. The membrane resistance of the ion-permeable diaphragms was the measured at 25° C. and 1000 Hz DC using a resistance measuring instrument (by Yanaco Analytical).

The results are shown in Table 1.

TABLE 1

| | Membrane type | Membrane resistance ($\Omega \cdot cm^2$) |
|---|---|---|
| Example 1 | FAP-containing membrane | 0.40 |
| Example 2 | HAP-containing membrane | 0.58 |
| Example 3 | $CaF_2$-containing membrane | 0.38 |
| Comp. example 1 | $ZrO_2$-containing membrane | 6.02 |

As Table 1 shows, the ion-permeable diaphragms of Examples 1 to 3 exhibited all a membrane resistance no greater than 1.00 $\Omega \cdot cm^2$, whereas the ion-permeable diaphragm of Comparative example 1, equivalent to that of Japanese Patent No. 2604734, exhibited a membrane resistance of 6.02 $\Omega \cdot cm^2$. In particular, membrane resistance was extremely low, at or below 0.40 $\Omega \cdot cm^2$, in the ion-permeable membranes of Example 1 and Example 3, which contained FAP and $CaF_2$, respectively.

[Electrolysis Voltage Measurement]

To calculate energy efficiency, electrolysis voltage was measured by carrying out electrolysis at 80° C., using the ion-permeable diaphragms of Examples 1 to 3 and Comparative example 1, in an electrolysis unit such as the one shown in FIG. 1, with a 25% KOH solution.

The results are shown in Table 2.

TABLE 2

| | Membrane type | Electrolysis voltage (V) | Energy efficiency ($kWh/Nm^3$) |
|---|---|---|---|
| Example 1 | FAP-containing membrane | 1.65 | 3.95 |
| Example 2 | HAP-containing membrane | 1.73 | 4.15 |
| Example 3 | $CaF_2$-containing membrane | 1.65 | 3.95 |
| Comp. example 1 | $ZrO_2$-containing membrane | 1.79 | 4.29 |

Upon carrying out electrolysis using the various ion-permeable diaphragms, the electrolysis voltages of the membranes of the Examples were lower, and hence their energy efficiency better, than was the case in the Comparative example, as Table 2 shows.

What is claimed is:

1. An ion-permeable diaphragm used in alkaline water electrolysis, wherein a membrane material of the ion-permeable diaphragm contains a calcium phosphate compound as a hydrophilic inorganic material.

2. The ion-permeable diaphragm according to claim 1, wherein the calcium phosphate compound as the hydrophilic inorganic material is fluoroapatite.

3. The ion-permeable diaphragm according to claim 2, wherein the thickness of the membrane material is 100 μm or greater.

4. The ion-permeable diaphragm according to claim 1, wherein the calcium phosphate compound as the hydrophilic inorganic material is hydroxyapatite.

5. The ion-permeable diaphragm according to claim 4, wherein the thickness of the membrane material is 100 μm or greater.

6. The ion-permeable diaphragm according to claim 1, wherein the membrane material is obtained by incorporating an organic fiber fabric into a mixture comprising the hydrophilic inorganic material and an organic binding material selected from among polysulfone, polypropylene and polyvinylidene fluoride.

7. The ion-permeable diaphragm according to claim 6, wherein the organic fiber fabric is a polypropylene mesh.

8. The ion-permeable diaphragm according to claim 7, wherein the thickness of the membrane material is 100 μm or greater.

9. The ion-permeable diaphragm according to claim 6, wherein the thickness of the membrane material is 100 μm or greater.

10. The ion-permeable diaphragm according to claim 1, wherein the thickness of the membrane material is 100 μm or greater.

* * * * *